US005185238A

United States Patent [19]

Oikawa

[11] Patent Number: 5,185,238

[45] Date of Patent: Feb. 9, 1993

[54] PHOTOGRAPHIC FILM ELEMENT

[75] Inventor: Toru Oikawa, Kanagawa, Japan

[73] Assignee: Fuji Photo Film Co., Ltd., Kanagawa, Japan

[21] Appl. No.: 729,966

[22] Filed: Jul. 15, 1991

[30] Foreign Application Priority Data

Jul. 16, 1990 [JP] Japan ..... 2-187800

[51] Int. Cl.[5] ..... G03C 1/76

[52] U.S. Cl. ..... 430/523; 430/501; 430/532; 430/536; 430/496; 430/961

[58] Field of Search ..... 430/501, 961, 532, 523, 430/496, 536

[56] References Cited

U.S. PATENT DOCUMENTS

| | | | |
|---|---|---|---|
| 4,092,173 | 5/1978 | Novak et al. | 430/531 |
| 4,143,013 | 3/1979 | Jenkinson et al. | 522/77 |
| 4,151,056 | 4/1979 | Park | 428/422 |
| 4,171,979 | 10/1979 | Novak et al. | 430/449 |
| 4,333,998 | 6/1982 | Leszyk | 430/532 |
| 4,384,040 | 5/1983 | Von Meer | 430/532 |
| 4,665,013 | 5/1987 | Sack et al. | 430/532 |
| 4,735,844 | 5/1988 | Ide et al. | 428/141 |
| 5,057,403 | 10/1991 | Kume et al. | 430/501 |

FOREIGN PATENT DOCUMENTS

| | | | |
|---|---|---|---|
| 0169849 | 9/1985 | Japan | 430/532 |
| 2-120856 | 5/1990 | Japan | 430/501 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A photographic element comprising (A): a photographic film patrone, having one end of a photographic film wound around a spool rotatably provided within the main body of the patrone, said film being delivered through the film outlet of the main body of the patrone to the outside by rotating said spool in the direction of film delivery and (B): a photographic film wherein at least one protective coat layer is provided on a support of said photographic film and said protective coat layer includes a radiation-cured resin.

15 Claims, 1 Drawing Sheet

PHOTOGRAPHIC FILM ELEMENT

FIELD OF THE INVENTION

The present invention relates to a photographic film having a protective coat layer, and more particularly to a photographic film having a protective coat layer for use in a cartridge system in which one end of a film is delivered through the film outlet of the main body of a patrone by rotating a spool.

BACKGROUND OF THE INVENTION

When the end of a film is pulled into the main body of a patrone in a photographic film which is wound around a spool into a roll and housed in a patrone, for example, in a 135 size film housed in a Patrone (ISO standard 1007 in 1979), the end of the film can not be delivered through a film outlet even when the spool is rotated in the direction of film delivery. Thus, the film is merely unwound from the spool. For this reason, the photographic films housed in a patrone on the market are such that one end of the film is previously pulled out from the main body of the patrone. When the film patrone is placed into a camera, the end of the film must be set at a predetermined position, for example, above the take up shaft of the camera. Such film placement is a very troublesome job for users such as inexperienced beginners.

A photographic film patrone which has improved structure with regard to the above-described disadvantage and enables one end of the film to be delivered through the film outlet by the rotation of the spool, is described in, for example, U.S. Pat. No. 4,832,275. The photographic film patrone has such a structure that a ring for preventing the wound-up film from being loosened is provided within the main body of the patrone, a triangular-shaped pawl is provided in the vicinity of the film outlet so as to allow the end of the uppermost film layer to be hooked by the pawl, and the end of the film is separated from a lower film layer positioned under the film end and is led to the film outlet.

However, when the film is delivered from the main body of the patrone by rotating the spool, there is a problem in that the film is rubbed against the inner side of the patrone, and the film is rubbed against itself. Hence, the surface of the film is apt to be marred. Some methods for preventing marring have been proposed. However, when these methods are applied to a cartridge system, a satisfactory effect can not be obtained.

For example, protective coats obtained from pentaerythritol triacrylate monomer and a pentaerythritol tetraalkylate monomer in the presence of a photopolymerization initiator as described in JP-A-61-172144 (the term "JP-A" as used herein means an "unexamined published Japanese Patent application") are poor in mar resistance. Protective coat layers described in U.S. Pat. Nos. 4,092,173 and 4,333,998 become sticky at high temperatures and have poor adhesion to photographic materials, though the coats have good mar resistance. Further, protective coats described in JP-A-61-201248, JP-A-61-201249, JP-A-61-201250 and JP-A-61-201251 are poor in adhesion to supports.

SUMMARY OF THE INVENTION

An object of the present invention is to provide a photographic element having a protective coat layer which is excellent in mar resistance and adhesion to the support in a cartridge system wherein one end of a film is delivered through the film outlet of the main body of a patrone.

The above-described object of the present invention has been achieved by providing a photographic element comprising (A): a photographic patrone, having one end of a photographic film wound around a spool rotatably provided within the main body of the patrone, said film being delivered through the film outlet of the main body of the patrone to the outside by rotating said spool in the direction of film delivery and (B): a photographic film wherein at least one protective coat layer is provided on the support of said photographic film and said protective coat layer comprises a radiation-cured resin.

Figure 1:
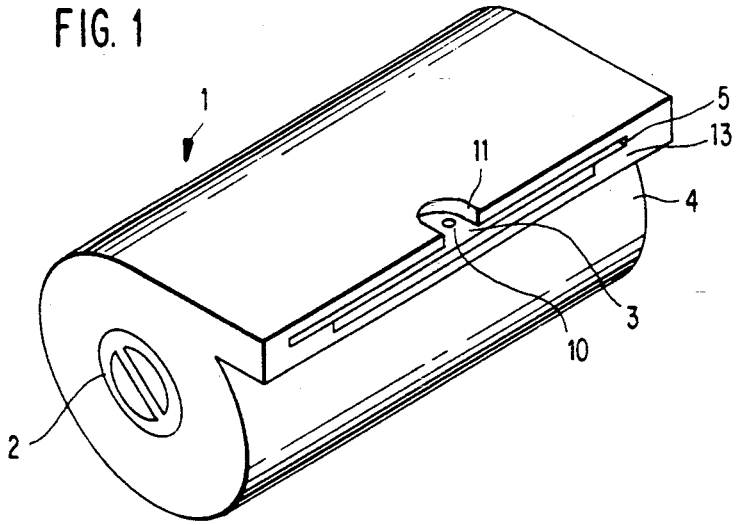
FIG. 1 is a perspective view of a photographic film patrone according to the present invention.

The numerals in FIGS. 1 to 4 represent the following.

1: Photographic film patrone, 2: Spool, 3: Photographic film, 4: Main body of a patrone, 5: Film outlet, 7: Perforation, 8: Raised part, 9: Protrusion, 10: Hole, 11: Notch, 12: Passage for film delivery, 13: Step part

DETAILED DESCRIPTION OF THE INVENTION

The present invention will be illustrated in more detail below.

The first essential ingredient of the radiation-curable composition used for the protective coat layer of the present invention is a urethane acrylate. The term "urethane acrylate", as used herein, refers to acrylic esters having a urethane bond group in the molecule. The urethane acrylate may be a monomer, an oligomer, a polymer or a mixture thereof. The urethane acrylate is a known material and is used in radiation-curable compositions. The urethane acrylate can easily form a cross-linked bond by appropriate irradiation.

In a preferred embodiment of the present invention, the urethane acrylate can be prepared by reacting a diisocyanate with a polyol and further reacting the reaction product with a hydroxyacrylate or a hydroxymethacrylate. Examples of the diisocyanate include, but are not limited to, tolylene diisocyanate, 4,4-diphenylmethane diisocyanate, xylylene diisocyanate, hexamethylene diisocyanate, methylenebis(4-cyclohexyl isocyanate) and trimethylhexamethylene diisocyanate. More preferred examples of the diisocyanate include aliphatic or alicyclic diisocyanates such as hexamethylene diisocyanate, methylenebis(4-cyclohexyl isocyanate), trimethylhexamethylene diisocyanate and isophorone diisocyanate. Examples of the polyol include, but are not limited to, butanediol, neopentyl glycol, ethoxylated bisphenol A, ethoxylated bisphenol S and spiroglycol. Examples of the hydroxyacrylate and the hydroxymethacrylate include, but are not limited to, 2-hydroxyethyl acrylate, 2-hydroxyethyl methacrylate and pentaerythritol triacrylate.

The second essential ingredient of the radiation-curable composition used for the protective coat layer of the present invention is a polyfunctional acrylate. The polyfunctional acrylate is an acrylic monomer having at least two acryloyloxy groups. This monomer is capable of increasing the hardness of the protective coat layer, enhancing adhesion and accelerating rapid curing in the radiation-curable composition. Examples of the polyfunctional acrylate include, but are not limited to, the following compounds (a) to (e).

(a) Tripropylene glycol diacrylate (TPGDA)

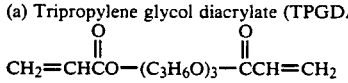

(b) Bisphenol A diglycidyl ether acrylate

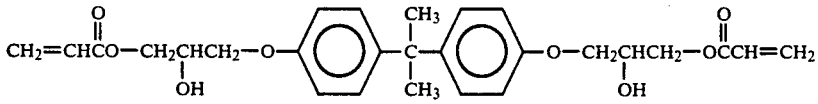

(c) Pentaerythritol triacrylate (PETA)

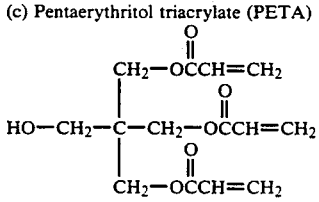

(d) Trimethylol propane triacrylate (TMPTA)

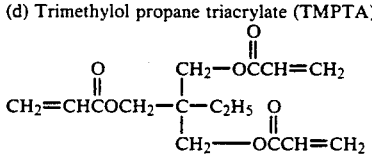

(e) Pentaerythritol tetraacrylate

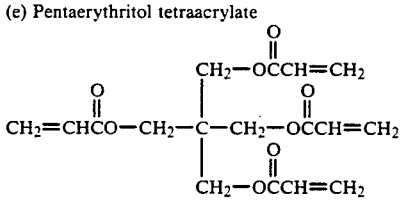

Other radiation-curable ingredients may be added to the protective coat layer of the present invention. An example of such an ingredient is a viscosity modifier for the composition. Examples of the viscosity modifier include ethyl acrylate, 2-ethylhexyl acrylate, N-vinylpyrrolidone and isobornyl acrylate.

The composition for forming the protective coat layer may be diluted with a solvent capable of dissolving the composition to improve coatability.

The composition ratio of the urethane acrylate and the polyfunctional acrylate for use in the formation of the protective coat layer of the present invention may be widely varied. The urethane acrylate is used in an amount of 5 to 95 wt %, preferably 10 to 90 wt %. The polyfunctional acrylate is used in an amount of 95 to 5 wt %, preferably 90 to 10 wt %. The thickness of the protective coat layer is preferably 0.1 to 20 μm, more preferably 3 to 10 μm.

Conventional types of radiation such as UV (ultraviolet light) and EB (electron beam) can be used in the present invention. Irradiation may be conducted under atmospheric pressure an inert atmosphere or vacuum.

The cartridge which is used in the present invention is mainly composed of a synthetic plastic.

If desired, a plasticizer may be mixed with the plastic in the preparation of the plastic of the present invention. Typical examples of the plasticizer include trioctyl phosphate, tributyl phosphate, dibutyl phosphate, diethyl sebacate, methyl amyl ketone, nitrobenzene, γ-valerolactone, di-n-octyl succinate, bromonaphthalene and butyl palmitate.

Specific examples of plastic materials which can be used in the present invention include, but are not limited to, polystyrene, polyethylene, polypropylene, polymonochlorotrifluoroethylene, vinylidene chloride resins, vinyl chloride resins, vinyl chloride-vinyl acetate copolymer resins, acrylonitrile-butadienestyrene copolymer resins, methyl methacrylate resins, vinyl formal resins, vinyl butyral resins, polyethylene terephthalate, nylon, phenolic resins and melamine resins.

Particularly preferred plastic materials which can be used in the present invention are polystyrene, polyethylene and polypropylene.

The cartridge of the present invention may contain various antistatic agents. Carbon black, metal oxides (e.g., $SnO_2/Sb$, $In_3O_3$, $V_2O_5$), nonionic, anionic, cationic and betaine surfactants and nonionic, anionic, cationic and betaine polymers can be preferably used as the antistatic agents, though the type of agent is not particular limited. Antistatic cartridges containing such agents are described in JP-A-1-312537 and JP-A-1-312538.

Generally, the cartridges are prepared by using plastics containing carbon black or pigment therein to impart light screening properties.

The size of the cartridge may be the same as currently employed cartridges. The currently used cartridges have a diameter of 25 m/m. A reduced size of 22 m/m or smaller, preferably between 20 m/m and 14 m/m, is effective in miniaturized cameras. The volume of the cartridge case is not larger than 30 $cm^3$, preferably not larger than 25 $cm^3$, more preferably not larger than 20

$cm^3$. The weight of the plastic to be used for the cartridge and the cartridge case is between 1 g and 25 g, preferably between 5 g and 15 g.

The ratio of the inner volume of the cartridge to the weight of the plastic used for the cartridge and the cartridge case is 4 to 0.7 $cm^3/g$, preferably 3 to 1 $cm^3/g$.

The form of the cartridge having a photographic film therein according to the present invention is illustrated below.

Figure 2:
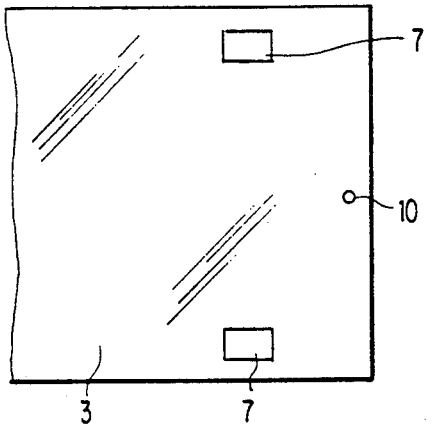
FIG. 2 is a plan view showing one end of a photographic film.
Figure 3:
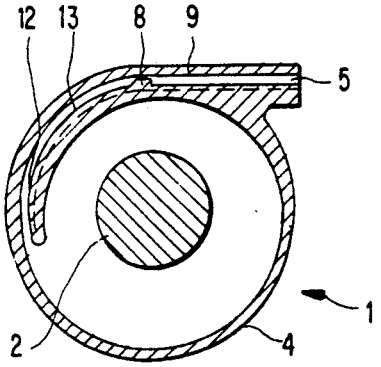
FIG. 3 is a sectional view of the patrone.
Figure 4:
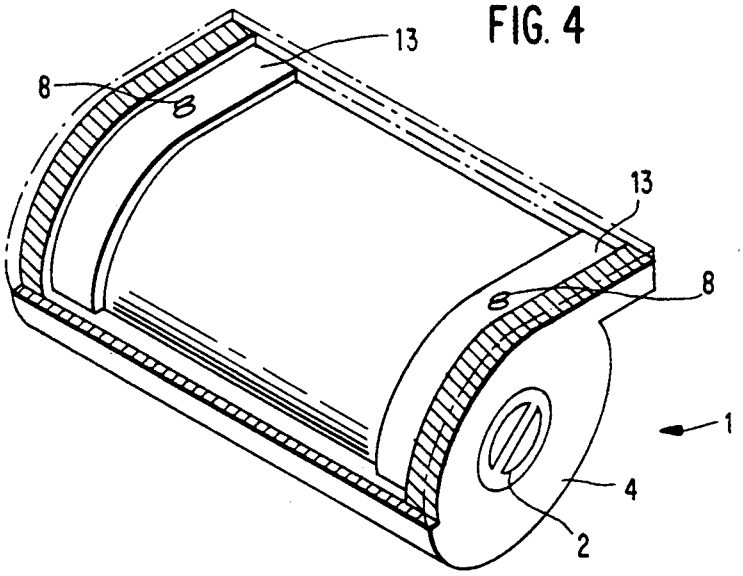
FIG. 4 is a partial cutaway view showing the inside of the patrone.

The cartridges used in the present invention are applied to cameras which use cartridges having a photographic film therein. An example of the cartridge is shown in FIG. 1 (FIG. 2 to FIG. 4 show the internal structure thereof).

Other examples of cartridges include those described in U.S. Pat. Nos. 4,883,235, 4,883,236, 4,887,112, 4,913,368, 4,834,306, 4,846,418 and 4,880,179.

Further details of the present invention are illustrated below.

Various plastic films can be used as supports for the photographic materials used in the present invention without particular limitation. Preferred examples of the supports include cellulose derivatives (e.g., diacetyl, triacetyl, propionyl, butanoyl, acetylpropionylacetate, etc.), polyamides, polycarbonates (described in U.S. Pat. No. 3,023,101), polyesters (described in JP-B-48-4044 (the term "JP-B" as used herein means an "examined Japanese patent publication"), e.g., polyethylene terephthalate, poly-1,4-cyclohexanedimethylene terephthalate, polyethylene naphthalate, etc.)), polystyrene, polypropylene, polyethylene, polysulfone, polyarylates and polyetherimides. Of these, triacetyl-cellulose and polyethylene terephthalate are particularly preferred.

Plasticizers are optionally added to these supports to impart flexibility, etc. Particularly, cellulose esters generally contain plasticizers such as triphenyl phosphate, biphenyl diphenyl phosphate and dimethyl ethyl phosphate.

The thickness of these supports varies depending on the types of the polymers. The supports range from a sheet of about 1 mm in thickness to a thin film of about 20 μm in thickness according to the use thereof. However, the supports which are generally used have a thickness of 50 to 300 μm.

The support polymers have a molecular weight of preferably not less than 10,000, more preferably 20,000 to 800,000.

The supports may contain dyes to neutralize the tint of the base, to prevent light piping or to impart antihalation.

These supports may be subjected to a surface activation treatment such as reagent treatment, mechanical treatment, corona discharge treatment, flame treatment, ultraviolet light treatment, high frequency treatment, glow discharge treatment, active plasma treatment, laser treatment, mixed acid treatment or ozone oxidation treatment to firmly bond photographic layers (e.g., light-sensitive silver halide emulsion layers, interlayers, filter layers, etc.) to the support. After the above treatment, photographic emulsions may be directly coated on the support. Alternatively, an undercoat layer may be provided on the support after the surface treatment or without the surface treatment, and photographic emulsion layers may then be coated.

When a cellulose derivative is used as the support, an undercoat is provided by coating a single layer with a solution of gelatin dispersed in a methylene chloride/-ketone/alcohol mixed organic solvent.

Suitable hardening agents for gelatin include chromium salts (e.g., chromium alum), aldehydes (e.g., formaldehyde, glutaraldehyde), isocyanates, active halogen compounds (e.g., 2,4-dichloro-6-hydroxy-s-triazine) and epichlorohydrin resins. The undercoating solutions used in the present invention may optionally contain various additives such as surfactants, anti-static agents, dyes for coloring antihalation agents, pigments, coating aids and anti-fogging agents. When the undercoating solutions of the present invention are used, etching agents such as resorcinol, chloral hydrate and chlorophenol can be contained in the undercoating solutions.

The underlayer used in the present invention may contain matting agents such as inorganic fine particles (e.g., $SiO_2$, $TiO_2$) and fine particles (1 to 10 μm) of polymethyl methacrylate copolymer.

The undercoating solution usable in the present invention can be coated by conventional coating methods such as dip coating, air-knife coating, curtain coating, roller coating, wire bar coating, gravure coating or extrusion coating method using a hopper as described in U.S. Pat. No. 2,681,294. If desired, two or more layers can be simultaneously coated by methods described in U.S. Pat. Nos. 2,761,791, 3,508,947, 2,941,898 and 3,526,528 and *Coating Engineering*, page 253, written by Yuji Harasaki (published by Asakura Shoten 1973).

The photographic material used in the present invention comprises silver halide emulsion layers, a back layer, a protective layer, an interlayer, an antihalation layer, etc. These layers are generally hydrophilic colloid layers.

Examples of binders which can be used for these hydrophilic colloid layers include protein such as gelatin, colloidal albumin and casein; cellulose derivatives such as carboxymethyl cellulose and hydroxyethyl cellulose; saccharide derivatives such as agar-agar, sodium alginate and starch derivatives; and synthetic hydrophilic colloid such as polyvinyl alcohol, poly-N-vinylpyrrolidone, polyacrylic acid copolymers, polyacrylamide and derivatives thereof and partial hydrolyzate dispersions thereof, dextran, polyvinyl acetate, polyacrylic esters and rosin. If desired, these colloids may be used as a mixture of two or more. Of these, gelatin and derivatives thereof are preferred. The term "gelatin" as used herein includes lime-processed gelatin, acid-processed gelatin and enzyme-processed gelatin.

In the present invention, anionic, nonionic, cationic and betaine fluorine-containing surfactants can be used.

These fluorine-containing surfactants are described in JP-A-49-10722, U.K. Patent 1,330,356, JP-A-53-84712, JP-A-54-14224, JP-A-50-113221, U.S. Pat. Nos. 4,335,201 and 4,347,308, U.K. Patent 1,417,915, JP-B-52-26687, JP-A-57-26719, JP-A-59-38573, JP-A-55-149938, JP-A-54-48520, JP-A-54-14224, JP-A-58-200235, JP-A-57-146248, JP-A-58-196544 and U.K. Patent 1,439,402.

Preferred examples of the fluorine-containing surfactants include the following compounds.

$$C_8F_{17}SO_3K \qquad \text{I-1}$$

$$C_7F_{15}COONa \qquad \text{I-2}$$

$$C_8F_{17}SO_3N(C_3H_7)-CH_2COOK \qquad \text{I-3}$$

-continued

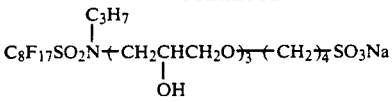

I-4

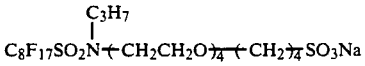

(I-5)

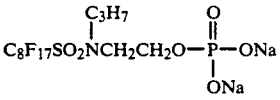

I-6

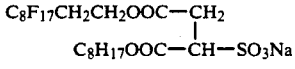

I-7

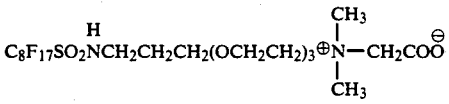

I-8

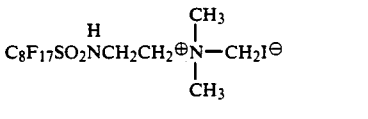

I-9

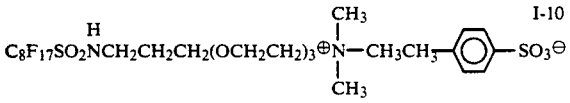

I-10

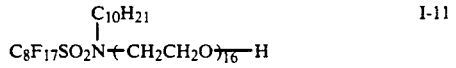

I-11

Nonionic surfactants may be used in the present invention.

Examples of the nonionic surfactants which can be preferably in the present invention include the following compounds.

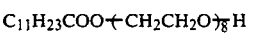

N-1

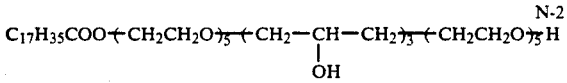

N-2

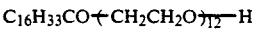

N-3

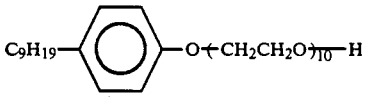

N-4

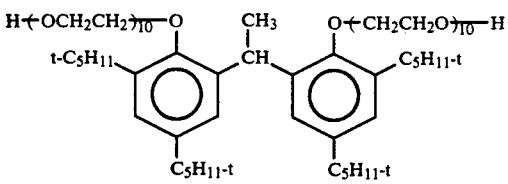

N-5

The fluorine-containing surfactant and the nonionic surfactant may be added to at least one layer of the photographic material without being limited to specific layers. For example, these surfactants may be added to a surface protective layer, an emulsion layer, interlayer, an undercoat layer or a back layer.

The fluorine-containing surfactant and the nonionic surfactant are used in an amount of 0.0001 to 1 g, more preferably 0.0005 to 0.5 g, particularly preferably 0.0005 to 0.2 g per $m^2$ of the photographic material. These surfactants may be used either alone or as a mixture of two or more.

Polyol compounds such as ethylene glycol, propylene glycol, and 1,1,1-trimethylolpropane described in JP-A-54-89626 can be added to the protective layer or other layer of the present invention.

Other conventional surfactants may be added singly or in combination to the photographic layers of the present invention. Generally, the surfactants are used as coating aids. However, the surfactants are optionally used for other purposes such as, for example, improving emulsifying dispersion, sensitization and other photographic characteristics, etc.

The photographic layers of the present invention may contain lubricating compositions such as modified silicones described in U.S. Pat. Nos. 3,079,837, 3,080,317, 3,545,970 and 3,294,537 and JP-A-52-129520. Further, higher fatty acid esters are effective as lubricants.

Further, the layers of the photographic material used in the present invention may contain polymer latex described in U.S. Pat. Nos. 3,411,911 and 3,411,912 and JP-B-45-5331.

The silver halide emulsion layers and other hydrophilic colloid layers of the photographic materials of the present invention can be hardened by various organic or inorganic hardening agents (singly or in combination).

Typical examples of silver halide color photographic material which are particularly preferable for use in the present invention include reversal color films and negative color films. Particularly preferred color photographic materials are general-purpose negative color films.

General-purpose negative color films are described below.

The photographic material of the present invention may comprise on a support, at least one silver halide emulsion layer having a blue-sensitive layer, green-sensitive layer and red-sensitive layer. There is no particular limitation with regard to the number of silver halide emulsion layers and non-sensitive layers and the order of the layers.

A typical example of the photographic material is a silver halide photographic material comprising on a support, at least one light-sensitive layer comprising a plurality of silver halide emulsion layers having substantially the same color sensitivity, but different light sensitivity. This type of light-sensitive layer, known as a unit light-sensitive layer, has color sensitivity to any one of blue light, green light and red light.

In multi-layer silver halide color photographic materials, unit light-sensitive layers are generally arranged in the order of a red-sensitive layer, a green-sensitive layer and a blue-sensitive layer arranged from the support side. However, the layers may be arranged in the reverse order, i.e. blue-sensitive layer, green-sensitive layer and red-sensitive layer, according to purpose. If desired, the arrangement may be such that a layer having different light sensitivity is interposed between layers having the same color sensitivity.

Non-sensitive layers such as interlayers may be optionally provided between the above-described silver halide light-sensitive layers, on the uppermost layer of the light-sensitive layers and on the lowermost layer thereof.

The interlayers may contain couplers, DIR compounds, etc. described in JP-A-61-43748, JP-A-59-113438, JP-A-59-113440, JP-A-61-20037 and JP-A-61-20038 and may also contain conventional color mixing inhibitors.

A plurality of silver halide emulsion layers which constitute each unit light-sensitive layer are described in West German Patent 1,121,470, U.K. Patent 923,045, JP-A-57-112751, JP-A-62-200350, JP-A-62-206541, JP-A-62-206543, JP-A-56-25738, JP-A-62-63936, JP-A-59-202464, JP-B-55-34934 and JP-B-49-15495.

Silver halide grains may have a regular crystal form such as a cube, octahedron or tetradecahedron, an irregular crystal form such as a sphere or a platy form, a crystal form having a defect in the crystal such as a twinning plane or a composite form thereof.

With regard to grain size, silver halide grains may range from fine grains having a grain size of not larger than about 0.2 μ to larger grains having a grain size of about 10 μ based on the projected areas of the grains. The grain size distribution thereof may be a polydisperse emulsion or a monodisperse emulsion.

Photographic silver halide emulsions which can be used in the present invention can be prepared by methods described in *Research Disclosure* (RD), No. 17643 (December, 1978), pages 22 to 23 "I. Emulsion Preparation and Types", Ibid., No.18176 (November, 1979), page 648, P. Glafkides, *Chemie et Phisique Photographique* (Paul Montel 1967), G. F. Duffin, *Photographic Emulsion Chemistry* (Focal Press. 1966) and V. L. Zelikman et al., *Making and Coating Photographic Emulsion* (Focal Press. 1964).

Monodisperse emulsions described in U.S. Pat. Nos. 3,574,628 and 3,655,394 and U.K. Patent 1,413,748 are preferable.

Tabular grains having an aspect ratio of not lower than about 5 can be used in the present invention. The tabular grains can be easily prepared by methods described in Gutoff, *Photographic Science and Engineering*, Vol. 14, pp 248 to 257, U.S. Pat. Nos. 4,434,226, 4,414,310, 4,433,048 and 4,439,520 and U.K. Patent 2,112,157.

Grain structure may be uniform, or halogen composition may be different between the interior of the grain and the surface layer thereof. The grain structure may be a laminar structure. Further, silver halides having different compositions may be joined to each other by epitaxial growth, or silver halide may be joined to a compound such as silver rhodanide or lead oxide other than silver halide.

If desired, a mixture of grains having various crystal forms may be used.

Generally, silver halide emulsions are subjected to physical ripening, chemical ripening and spectral sensitization before use. The effects of the present invention are particularly remarkable when emulsions sensitized with gold compounds and sulfur compounds are used. Additives used in such stages are described in *Research Disclosure* No. 17643 and Ibid., No. 18716 are provided in the following table.

Conventional photographic additives which are used in the present invention are also described in the above-described two Research Disclosures and set forth in the following table.

| Additive | RD 17643 | RD 18716 |
|---|---|---|
| 1. Chemical sensitizing agent | page 23 | page 648 (right column) |
| 2. Sensitivity increaser | | page 648 (right column) |
| 3. Spectral sensitizing agent, supersensitizing agent | pages 23 to 24 | page 648 (right column) to page 649 (right column) |
| 4. Brightener | page 24 | |
| 5. Anti-fogging agent, stabilizer | pages 24 to 25 | page 649 (right column) |
| 6. Light absorber, filter dyes, ultraviolet light absorber | pages 25 to 26 | page 649 (right column) to page 650 (left column) |
| 7. Antistaining agent | page 25 (right column) | page 650 (left column) to (right column) |
| 8. Dye image stabilizer | page 25 | |
| 9. Hardening agent | page 26 | page 651 (left column) |
| 10. Binder | page 26 | page 651 (left column) |
| 11. Plasticizer, lubricant | page 27 | page 650 (right column) |
| 12. Coating aid, surfactant | pages 26 to 27 | page 650 (right column) |

It is preferred that compounds capable of reacting with formaldehyde to fix formaldehyde gas as described in U.S. Pat. Nos. 4,411,987 and 4,435,503 are added to the photographic material used in the present invention.

Various color couplers can be used in the present invention. Examples thereof are described in the specifications of patents cited in the aforesaid *Research Disclosure* (RD) No. 17643, VII-C to VII-G.

The couplers used in the present invention can be introduced into the photographic materials by, various conventional dispersion methods.

High-boiling solvents which are used for oil-in-water dispersion methods are described in U.S. Pat. No. 2,322,027, etc.

Examples of high-boiling organic solvents having a boiling point of not lower than 175° C. under atmospheric pressure which are used in the water-in-oil dispersion methods include phthalic esters, phosphoric or phosphonic esters, benzoic esters, amides, alcohols, phenols aliphatic carboxylic acid esters, aniline derivatives and hydrocarbons.

Co-solvents, which may be used, include organic solvents having a boiling point of not lower than about 30° C., preferably not lower than 50° C., but not higher than 160° C. Examples thereof include ethyl acetate, butyl acetate, propionic esters, methyl ethyl ketone, cyclohexanone 2-ethoxyethyl acetate and dimethylformamide.

The stages and effects of latex dispersion methods and examples of impregnating latexes are described in U.S. Pat. No. 4,199,363, West Patent Application (OLS) Nos. 2,541,274 and 2,541,230.

It is preferred that the sum total of the layer thickness of all the hydrophilic colloid layers on the emulsion layer side of the photographic material of the present invention is not more than 28 μm, and the layer swelling rate $T_{1/2}$ is not longer than 30 seconds. The layer thickness is measured under moisture conditions at 25° C. and 55% RH for 2 days. The layer-swelling rate $T_{1/2}$ can be measured by conventional methods known in the art. For example, the layer-swelling rate can be measured by using a swellometer of a type described in A. Green et al., *Photographic Science Engineering*, Vol. 19, No.2, pages 124 to 129. $T_{1/2}$ defines the time elapsed until the layer thickness reaches ½ of the saturated layer thickness. The saturated layer thickness is defined as 90% of the maximum swelling layer thickness attainable by processing a photographic material with a color developing solution at 30° C. for 3¼ minutes.

The layer-swelling rate $T_{1/2}$ can be adjusted by adding a hardening agent to gelatin used as a binder or by changing conditions with time after coating. The swelling ratio of the layer is preferably 150 to 400%. The swelling ratio can be calculated from the maximum swelling layer thickness under the above-described conditions by using the following formula.

Swelling ratio = (maximum swelling layer thickness − layer thickness)/layer thickness Color photographic materials according to the present invention can be developed by conventional methods described in the aforesaid RD, No.17643 (pages 28 to 29) and Ibid., No.18716 (left column to right column of page 615).

The silver halide color photographic materials of the present invention may contain color developing agents to simplify and expedite processing. It is preferred that precursors of a color developing agents be contained in the color photographic materials. Examples thereof include indoaniline compounds described in U.S. Pat. No. 3,342,597, Schiff base type compounds described in U.S. Pat. No. 3,342,599, *Research Disclosure* 14,850 and Ibid., 15,159 and compounds described in *Research Disclosure* 13,924.

The present invention is now illustrated in greater detail by reference to the following examples which, however, are not to be construed as limiting the invention in any way.

EXAMPLE 1

The following composition was coated on a support by means of wire bar coating, dried at 60° C. and then irradiated with ultraviolet light (the treatment conditions of samples being varied as shown in Table 1). UV irradiation was conducted in a $N_2$ atmosphere for 5 seconds using a 120 w/cm lamp. The prepared Samples are shown in Table 1.

| Composition (a) | |
|---|---|
| SARTOMAR 9505 (urethane acrylate, manufactured by Somar Corp.) | 15 g |
| Pentaerythritol triacylate | 15 g |
| Acetone | 70 g |
| 1-Hydroxycyclohexyl phenyl ketone | 1.5 g |

Composition (b)

The same as composition (a) except that pentaerythritol tetraacrylate was used in place of pentaerythritol triacrylate.

Composition (c)

The same as the composition (a) except that 16 g of N-vinyl-pyrrolidone was used in place of acetone and the amount of 1-hydroxycyclohexyl phenyl ketone was changed from 1.5 g to 2.3 g.

| Composition (d) | |
|---|---|
| Diacetylcellulose | 2 g |
| Acetone | 85 g |
| Methanol | 15 g |

Composition (e)

The same as composition (a) except that SARTOMAR, used in composition (a), was omitted.

Composition (f)

The same as composition (a) except that pentaerythritol triacrylate, used in composition (a), was omitted.

TABLE 1

| Sample No. | Support[1)] | Coating composition[2)] | Drying condition | UV Irradiation | Coated thickness[3)] on a solid basis |
|---|---|---|---|---|---|
| 1-1 | (A) | — | — | — | — |
| 1-2 | " | (a) | 60° C., 1 hour | in a $N_2$ atm. for 5 sec. | 5μ |
| 1-3 | " | (b) | " | in a $N_2$ atm. for 5 sec. | " |
| I-4 | " | (c) | not dried | in 2 $N_2$ atm. for 5 sec. | " |
| I-5 | (B) | — | — | — | — |
| I-6 | " | (a) | 60° C., 1 hour | in a $N_2$ atm. for 5 sec. | 5μ |
| I-7 | " | (b) | not dried | in a $N_2$ atm. for 5 sec. | " |
| I-8 | (A) | (c) | 60° C., 1 hour | not irradiated | " |
| I-9 | " | (e) | " | in a $N_2$ atm. for 5 sec. | 5μ |
| I-10 | " | (f) | " | in a $N_2$ atm. for 5 sec. | " |

Note
[1)]Support:
(A) Triacetylcellulose film (122μ)
(B) polyethylene terephthalate film (100μ)
[2)]Coating composition: the aforesaid compositions (a) to (f)
[3)]Thickness on a solid basis: coated thickness on a solid basis after drying.

The degree of difficulty in marring was evaluated by the following tests (1) and (2).

(1) Scratch Strength

A diamond needle having a tip of 0.0025 mmR was perpendicularly positioned on the surface of the sample. While a load was continuously applied thereto, the surface of the sample was scratched at a speed of 60 cm/min. After scratching, the sample was placed on a light table, and the load under which mar began to appear through transmission was referred to as scratch strength (25° C., 60% RH).

(2) Surface Rubbing Resistance

A load of 500 g was applied to 1 $cm^3$ of KIKURON brush (made by Scotch-Brite of 3M) and the surface of the sample was rubbed once therewith at a speed of 60 cm/min. The degree of marring which could be observed by reflected light was examined. The evaluation was made in three grades (25° C., 60% RH). The results are shown in Table 2 in which the mark ○ means that the sample is the most difficultly marred, the mark x means that the sample is the most easily marred and the mark Δ means a medium degree of marring.

TABLE 2

| Sample No. | Scratch resistance(g) | Rubbing resistance | Remarks |
|---|---|---|---|
| I-1 | 15 | X | Comp. Ex. |
| I-2 | 105 | ○ | invention |
| I-3 | 100 | ○ | " |
| I-4 | 90 | ○ | " |
| I-5 | 20 | X | Comp. Ex. |
| I-6 | 100 | ○ | invention |
| I-7 | 90 | ○ | " |
| I-8 | 20 | X | Comp. Ex. |
| I-9 | 50 | ○ | " |
| I-10 | 30 | Δ | " |

It is apparent from Table 2 that the samples of the present invention are improved in scratch resistance as well as surface rubbing resistance and give good results of as high as 90 to 105 g with regard to scratch resistance.

EXAMPLE 2

(2-1) : Preparation of Support

An undercoat comprising mainly gelatin was coated on the side opposite to the coated side of each of bases 1-1, 1-2, 1-3, 1-6 and 1-8 prepared in Example 1. The following layers were then coated on the undercoat to prepare multi-layer color photographic materials 2-1, 2-2, 2-3, 2-4 and 2-4 which are shown in Table 3 below.

TABLE 3

| Sample No. | Base No. (described in Example 1) |
|---|---|
| 2-1 | 1-1 |
| 2-2 | 1-2 |
| 2-3 | 1-3 |
| 2-4 | 1-6 |
| 2-5 | 1-8 |

(2-2) Preparation of Light Sensitive Material

The opposite side to the back layer of the undercoated cellulose triacetate film support was subjected to a glow discharge treatment and then coated with the following layers having the following compositions to prepare multi-layer color photographic materials as samples.

Composition of Sensitive Layer

Light-sensitive layers were prepared in the same manner as the light-sensitive layers described in Example 1 of JP-A-2-93641.

(2-3) Working of Sample

Each sample was cut into a film of 24 exposures of a 35 mm wide format shown by FIG. 2.

(2-4) Development

These sample were developed in the following manner.

| | |
|---|---|
| Color development | 3 min. 15 sec |
| Bleaching | 6 min. 30 sec. |
| Rinse | 2 min. 10 sec |
| Fixing | 4 min. 20 sec. |
| Rinse | 3 min. 15 sec |
| Stabilization | 1 min. 05 sec. |

Each processing solution used in the above stage had the following composition.

| | |
|---|---|
| Color development | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| | pH 10.0 |
| Bleaching solution | |
| Ammonium ethylenediaminetetraacetato ferrate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| | pH 6.0 |
| Fixing solution | |
| Disodium ethylenediaminetetraacetate | 1.0 g |
| Sodium sulfite | 4.0 g |
| Aqueous solution of ammonium thiosulfate (70%) | 175.0 ml |
| Sodium bisulfite | 4.6 g |
| Water to make | 1.0 liter |
| | pH 6.6 |
| Stabilizing solution | |
| Formalin (40%) | 2.0 ml |
| Polyoxyethylene p-monononyl phenyl ether (average degree of polymerization: 10) | 0.3 g |
| Water to make | 1.0 liter |

Each of the samples prepared above was put into a photographic film patrone shown in FIG. 1. After the sample was placed in the patrone, exposed, and then removed from the patrone, the above-described development was carried out. After development, 10 rolls of the samples were inspected in the following a manner: (1)the samples were placed on a light table and the number of scratches which could be observed by transmitted light was examined; and (2) the number of scratches which were formed on the opposite side to the light-sensitive layer-coated side and could be observed by reflected light was examined. The results are shown in Table 4.

TABLE 4

| Sample No. | (1) Scratches which could be observed by transmitted light | (2) Scratches which could be observed by reflected light | |
|---|---|---|---|
| 2-1 | X[1)] | X | Comp. Ex. |
| 2-2 | ○[2)] | ○ | invention |
| 2-3 | ○ | ○ | " |
| 2-4 | ○ | ○ | " |
| 2-5 | X | X | Comp. Ex. |

1), 2) { ○: scarcely marred. X: marred.

It can be understood from Table 4 that photographic materials which are difficult to mar can be obtained by the present invention.

EXAMPLE 3

In the same manner as Example (2-1), a support and a back layer were prepared. The reversal color emulsion layers described in sample 101 of Example 1 of JP-A-2-854 were coated on the side of the support opposite to the back layer. Development was carried out by CR-56 processing of reversal color development of Fuji Photo Film Co., Ltd.

The resulting samples 3-2, 3-3, and 3-4 according to the present invention were excellent in mar resistance, while comparative samples 3-1 and 3-5 had poor mar resistance.

While the present invention has been described in detail and with reference to specific embodiments thereof, it will be apparent to one skilled in the art that various changes and modifications can be made without departing from the spirit and scope of the present invention.

I claim:

1. A photographic element comprising (A): a photographic patrone, having one end of a photographic film wound around a spool rotatably provided within the main body of the patrone, said film being delivered through the film outlet of the main body of the patrone to the outside by rotating said spool in the direction of film delivery and (B): a photographic film wherein at least one protective coat layer is provided on a support of said photographic film and said protective coat layer comprises a composition containing (I) at least one urethane acrylate wherein the urethane acrylate is prepared by reacting (a) a diisocyanate selected from the group consisting of hexamethylene diisocyanate, methylenebis(4-cyclohexyl isocyanate), trimethylhexamethylene diisocyanate, hexamethylene diisocyanate, methylenebis(4-cyclohexyl isocyanate), and trimethyl hexamethylene diisocyanate with (b) a polyol and further reacting the reaction product with (c) a hydroxyacrylate or hydroxymethacrylate and (II) at least one polyfunctional acrylate selected from the group consisting of pentaerythritol triacrylate and pentaerythritol tetraacrylate and said protective coated layer is provided on the side of the support opposite the side containing photosensitive layers, said protective coat layer is cured by radiation before the photographic sensitive layers are coated.

2. A photographic film as in claim 1, wherein said photographic film is a color photographic film.

3. A photographic element as in claim 2, wherein said protective coat layer comprises a composition containing at least one urethane acrylate and at least one polyfunctional acrylate.

4. A photographic element as in claim 2, wherein said protective coat layer is provided on the side of the support opposite the side containing photosensitive layers, and said protective coat layer is cured by radiation before the photosensitive layers are coated.

5. A photographic element as in claim 1, wherein said urethane acrylate is prepared by reacting a diisocyanate with a polyol to obtain a reaction product, and then reacting the reaction produce with a hydroxy acrylate or a hydroxy methacrylate.

6. A photographic element as in claim 1, wherein said polyfunctional acrylate is selected from the group consisting of tripropylene glycol diacrylate, bisphenol A diglycidyl ether acrylate, pentaerythritol triacrylate, trimethylol propane triacrylate and pentaerythritol tetraacrylate.

7. A photographic element as in claim 1, wherein said urethane acrylate is present in an amount of from 5 to 95 wt %.

8. A photographic element as in claim 7, wherein said urethane acrylate is present in an amount of from 10 to 90 wt %.

9. A photographic element as in claim 1, wherein said polyfunctional acrylate is present in an amount of from 95 to 5 wt %.

10. A photographic element as in claim 9, wherein said polyfunctional acrylate is present in an amount of from 90 to 10 wt %.

11. A photographic element as in claim 1, wherein said protective coat layer has a thickness of from 0.1 to 20 μm.

12. A photographic element as in claim 11, wherein said protective coat layer has a thickness of from 3 to 10 μm.

13. A photographic element as in claim 1, wherein the patrone had a diameter of 25 m/m or smaller and a volume not larger than 30 $cm^3$.

14. A photographic element as in claim 1, wherein the polyol is selected from the group consisting of butanediol, neopentyl glycol, ethoxylated bisphenol A, ethoxylated bisphenol S, and spiroglycol.

15. A photographic element as in claim 1, wherein the hydroxyacrylate or hydroxymethacrylate is selected from the group consisting of 2-hydroxyethyl acrylate, 2-hydroxyethyl methacrylate, and pentaerythritol triacrylate.

* * * * *